US005282284A

United States Patent [19]

Brantman et al.

[11] Patent Number: 5,282,284

[45] Date of Patent: * Feb. 1, 1994

[54] SLIDING TRANSFER DEVICE

[75] Inventors: Robert F. Brantman, Lake Forest, Ill.; Frank L. Brantman, Plymouth, Minn.

[73] Assignee: Robert F. Brantman, Inc., Lake Forest, Ill.

[ * ] Notice: The portion of the term of this patent subsequent to Jan. 29, 2008 has been disclaimed.

[21] Appl. No.: 796,325

[22] Filed: Nov. 22, 1991

Related U.S. Application Data

[63] Continuation-in-part of Ser. No. 642,416, Jan. 17, 1991, Pat. No. 5,067,188, which is a continuation-in-part of Ser. No. 519,290, May 4, 1990, Pat. No. 4,987,621.

[51] Int. Cl.[5] ..... A61G 7/053; A61G 7/10

[52] U.S. Cl. ..... 5/81.1

[58] Field of Search ..... 5/81.1, 86; 193/35 R; 414/921

[56] References Cited

U.S. PATENT DOCUMENTS

| | | | |
|---|---|---|---|
| 758,493 | 4/1904 | Abbey | 414/541 |
| 799,699 | 9/1905 | Winter . | |
| 1,876,922 | 9/1932 | Hamilton . | |
| 2,565,761 | 8/1951 | Dean | 5/86.1 |
| 2,691,782 | 10/1954 | West | 5/81.1 |
| 3,786,523 | 1/1974 | Sele | 5/81.1 |
| 3,962,736 | 6/1976 | Fedele | 5/81.1 |
| 4,137,581 | 2/1979 | Daly | 5/81.1 |
| 4,259,756 | 4/1981 | Pace | 5/81.1 |
| 4,644,594 | 2/1987 | Johnson | 5/81.1 |
| 4,815,785 | 3/1989 | Goodall et al. | 414/921 |
| 4,987,621 | 1/1991 | Brantman | 5/81.1 |
| 5,067,188 | 11/1991 | Brantman | 5/81.1 |
| 5,079,789 | 1/1992 | Jandrakovic | 5/81.1 |

FOREIGN PATENT DOCUMENTS

| | | |
|---|---|---|
| 722480 | 11/1965 | Canada . |
| 141818 | 7/1987 | China . |
| 2809526 | 9/1979 | Fed. Rep. of Germany . |

OTHER PUBLICATIONS

Preston, 1989 Winter Catalog, PC 7087 p. 148.

Fabrication Enterprises Inc., 1988 Catalog, p. 62.

*Primary Examiner*—Alexander Grosz

*Attorney, Agent, or Firm*—Willian Brinks Hofer Gilson & Lione

[57] ABSTRACT

A sliding transfer device comprising a lower support plate and an upper seat. The upper seat is removably attached to the lower support plate, and slides and rotates over the top surface of the plate. A person being transferred from one location to another, such as the edge of a bed to a wheelchair seat, is placed upon the upper seat, and is transferred as the seat slides across the top surface of the lower support plate. The lower support plate may be straight, curved, or S-shaped and may be constructed by joining top and bottom sections that are hollow and reinforced by cross members or ribs.

22 Claims, 7 Drawing Sheets

SLIDING TRANSFER DEVICE

CROSS REFERENCE TO RELATED APPLICATION

This application is a continuation-in-part of application Ser. No. 642,416, filed Jan. 17, 1991. now U.S. Pat. No. 5,067,188 which is a continuation-in-part of application Ser. No. 519,290, filed May 4, 1990, now U.S. Pat. No. 4,987,621.

FIELD OF THE INVENTION

This invention relates to a device for transferring a patient from one location to another. More specifically, the invention relates to a sliding device for transferring a patient between two proximate locations such as a bed and a wheelchair.

BACKGROUND OF THE INVENTION

Those with lower extremity disabilities often have difficulty moving from one location to another. Often times these people are confined to a wheelchair and require assistance to transfer between a bed, tub, or commode to a wheelchair or similar device.

Presently, assistance in transferring patients can be provided by transfer boards, which are generally solid, smooth, rectangular-shaped, plywood boards, approximately 8 inches wide and 24 to 30 inches long. To move a patient from a bed to a wheelchair, for example, one end of the rectangular transfer board is placed under the patient sitting on the edge of the bed, and the other end of the board is placed on the wheelchair seat. Generally with the assistance of at least one person, the patient slides across the board from the bed toward the wheelchair. The patient then sits on the corner of the wheelchair seat, and makes a half turn, backwards into the wheelchair, as the transfer board is removed.

This operation usually requires considerable strength and effort by the patient. If the patient lacks the required strength, as in the case of a disabled person or some senior citizens, more than one person may be needed to help slide the patient across the transfer board. But, this becomes a problem when the only assistance available is from someone who also is disabled, or more commonly, a senior citizen.

It therefore is an object of the present invention to greatly reduce the amount of assistance required in transferring a patient or invalid between proximate locations. It is further an object of the present invention to reduce the amount of turning the patient must endure in transferring between these locations. These and other objectives are accomplished by the sliding transfer device described.

FIGS. **10*a*–10*c*** illustrates an upper seat that is adapted to fit into other surfaces.

Figure 11A:
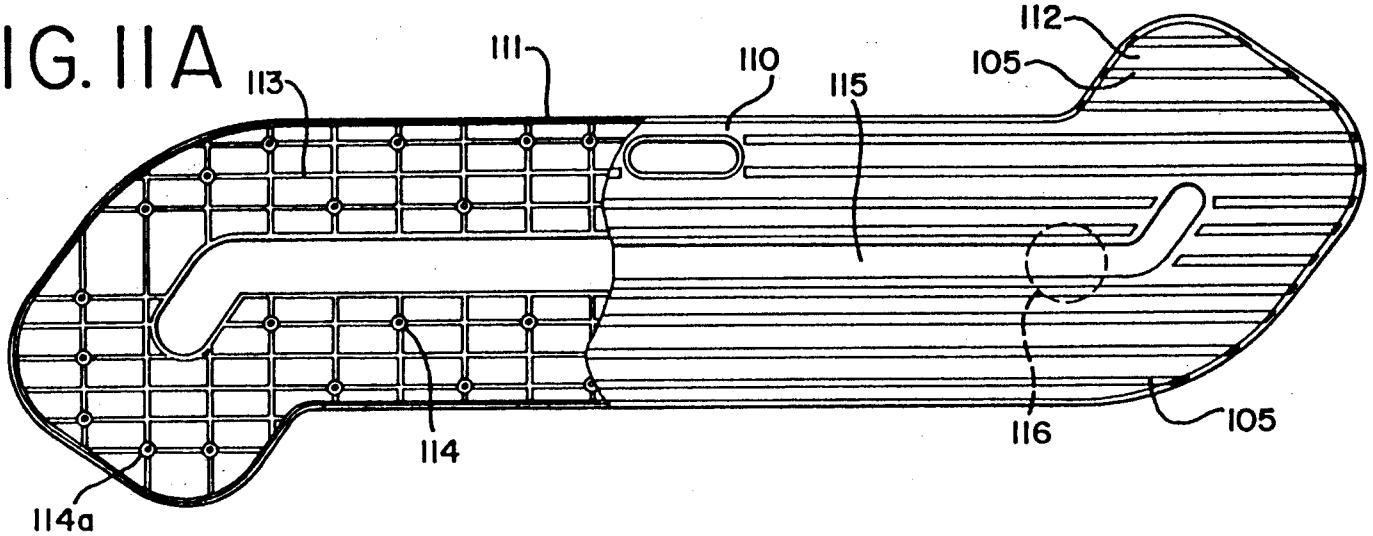
Figure 11B:
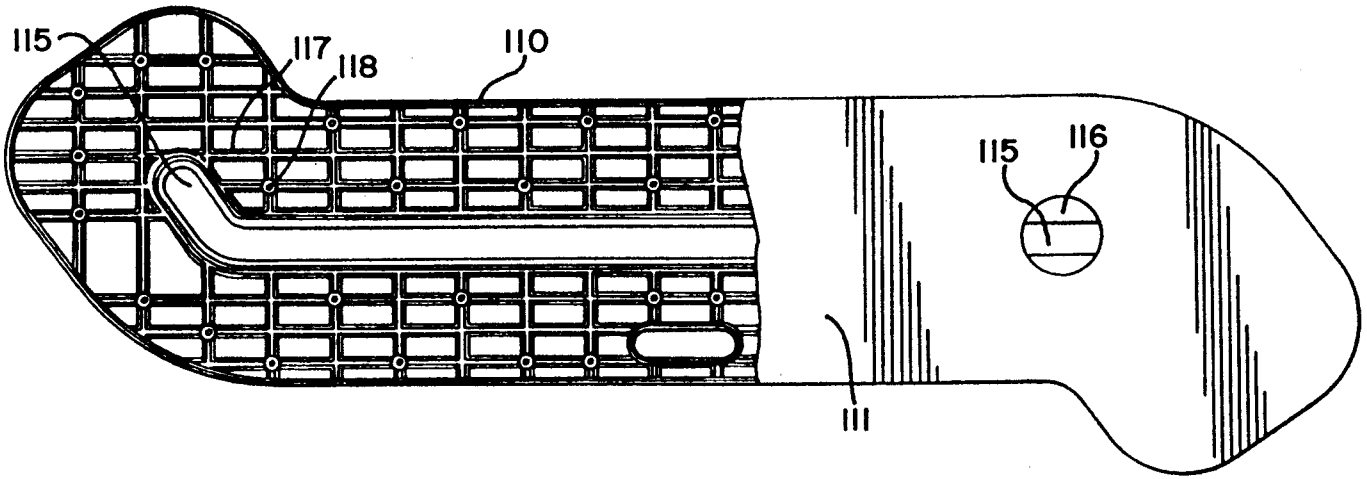

FIGS. 11A–11B illustrates an assembled lower support plate with top and bottom sections.

Figure 12A:
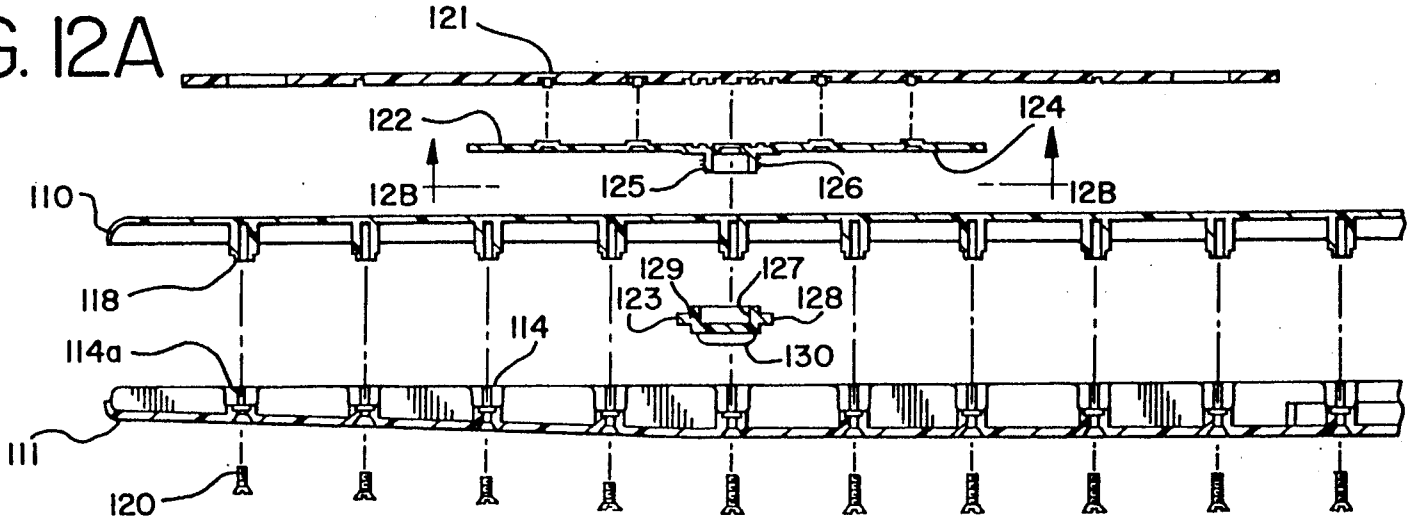
Figure 12B:
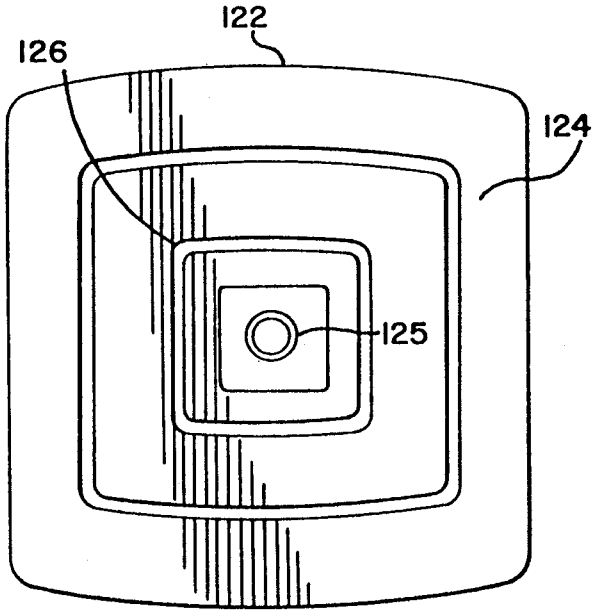

FIGS. 12A–12B illustrates an exploded side view of a sliding transfer device of the present invention and a bottom view of the upper seat.

SUMMARY OF THE INVENTION

The present invention relates to a substantially rectangular, or curved, sliding transfer device. In one embodiment, the device comprises an upper seat member slidably attached to a lower support plate having a substantially flat top surface. To transfer a patient from a bed to a wheelchair, for example, one end of the lower support plate is placed under the patient at the edge of the bed. The other end is placed on the edge of the wheelchair seat. The upper seat is moved under the patient. The patient sits on the upper seat, and is carried by the seat as it slides across the top surface of the lower support plate toward the edge of the wheelchair seat. At the wheelchair seat, the patient turns backwards into the wheelchair with considerably less difficulty than with presently available boards. The sliding transfer device is then removed from beneath the patient.

In another embodiment, the top surface of the lower support plate is curved or arranged in one or more arcs. To transfer a patient, one end of the lower support plate and the seat are placed under the patient and on the edge of the bed, and the other end is placed on the edge of the wheelchair seat. In this embodiment, the sliding transfer device is placed between the bed and wheelchair seat so that, as the patient slides across the curvature of the top surface, the patient's back is turned toward the wheelchair back. Thus, in this embodiment, the patient needs to turn only slightly backward into the wheelchair seat, further reducing the difficulty of transferring.

In another embodiment, the top portion of the lower support member is curved at both ends to form an S-shape, and the center portion is either substantially rectangular, or slightly arranged in an arc. The patient is transferred in the same way as already described.

In yet another embodiment, the upper seat member is slidably joined to the lower support plate by a swivel. The swivel enhances transfer of the patient because it allows either the seat or the support plate to pivot freely as the patient is moved on and off of the upper seat. The swivel feature may be used with any of the lower support plate embodiments.

In another embodiment, the upper seat member also contains flexible flaps, which may be used as handles to assist in moving the patient. The flexible flaps assist in placing the seat under the patient, and protect clothing or parts of the patient's body from becoming entangled between the upper seat and the lower support plate. This seat embodiment may be optionally mounted with the swivel embodiment, and either combination may be used with and of the lower support embodiment.

In another embodiment, the upper seat is removably attached to the lower support member by placing removable inserts in the open-ended track ends. When the inserts are removed, the upper seat may be slid on and off the track as desired. The patient is transferred to the desired location and the upper seat is then slid out from under the patient.

In a further embodiment, the removable upper seat is adapted to fit into other surfaces or objects, such as the seat of a wheelchair. Thus, the patient remains on the upper seat after being transferred to the desired location. The means employed for adapting the upper seat also provide additional support for the seat when affixed to the lower support member.

DETAILED DESCRIPTION OF THE DRAWINGS AND PREFERRED EMBODIMENTS

Figure 1:
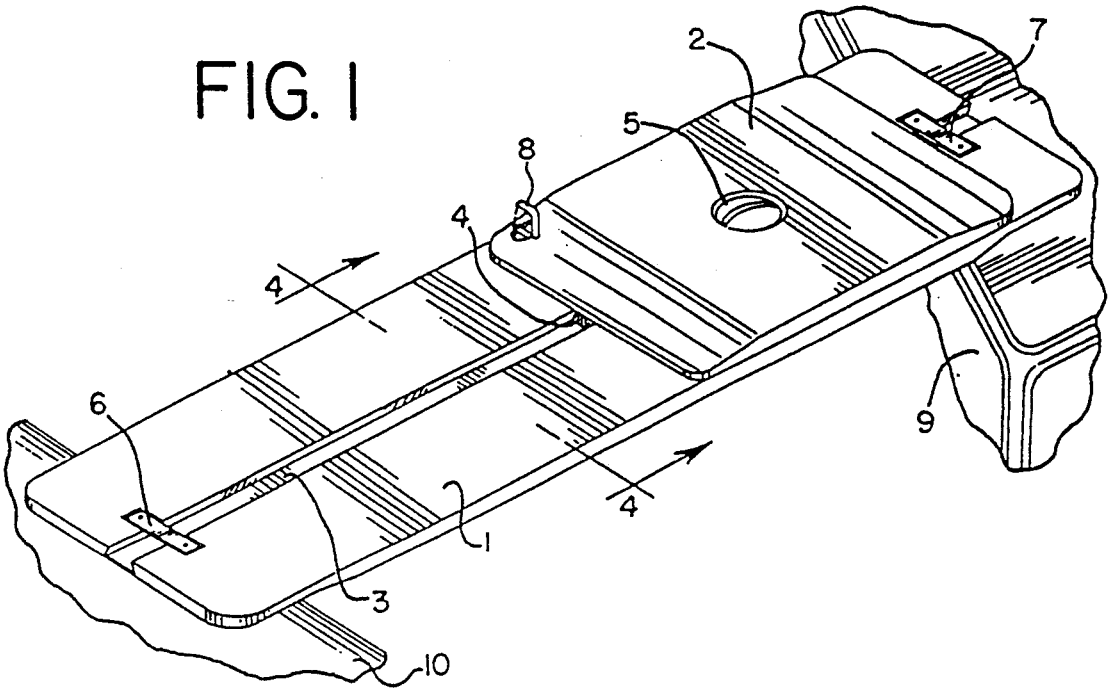
FIG. 1 illustrates a sliding transfer device of the present invention comprising a substantially rectangular lower support plate.
Figure 4:
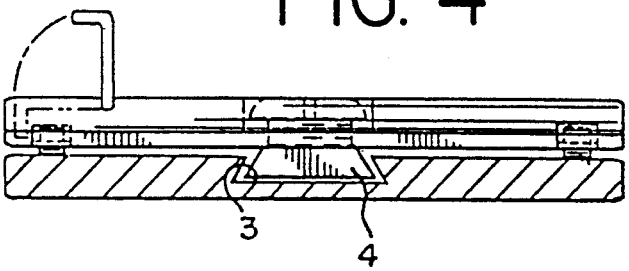
FIG. 4 illustrates a section view of FIG. 1.

FIG. 1 illustrates one embodiment of the sliding transfer device of the present invention. This embodiment comprises a lower support plate 1 having a substantially flat, rectangular top surface, and an upper seat 2. The upper seat is slidably affixed to the lower support member by a track and guide assembly. In this embodiment, track 3 comprises a female recess running the length of the lower support plate. As shown in FIG. 4, a male guide 4 is fixed within the recessed track. The male guide may comprise a continuous wedge shaped guide 4 set within the recessed track 3. An adjustable tension screw 5 may be employed to further assist in attaching upper seat 2 to lower support plate 1, and to control the movement of the seat across the lower support plate. Lock plates 6 and 7 may also be located at either end of lower support plate 1 to keep the upper seat on the recessed track. Locking device 8 enhances patient safety and control over movement of seat 2.

In operation, lower support plate 1 is laid across the edge of a bed 9 and the edge of wheelchair seat 10. To transfer from the bed to the wheelchair, the patient sits on upper seat 2. The patient is carried from the bed to the wheelchair as upper seat 2 slides across the top surface of lower support plate 1. Because of the sliding action of the upper seat, the patient requires much less assistance when transferring from one proximate location to another.

Figure 2:
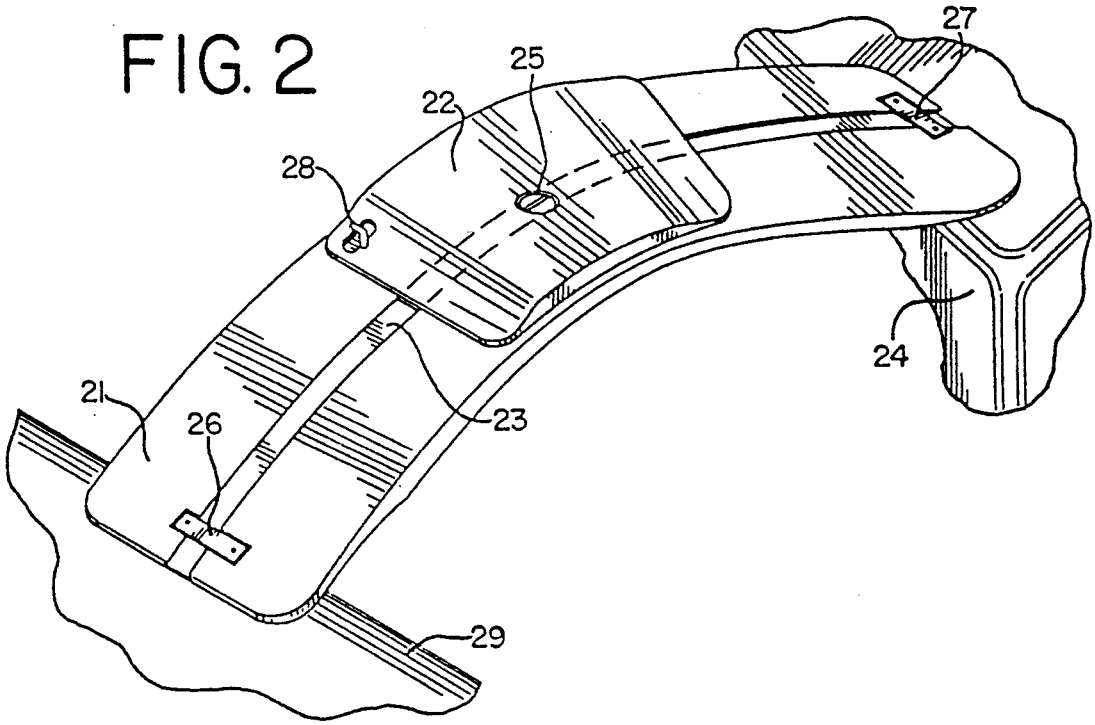
FIG. 2 illustrates a sliding transfer device of the present invention comprising a curved lower support plate.

FIG. 2 illustrates another embodiment of the present invention containing curved lower support plate 21. In this embodiment, curve-shaped upper seat 22 is slidably attached to lower support plate 21 by a guide and track assembly. Track 23 also is curved in accordance with the curvature of lower support plate 21. Adjustable tension screw 25, locking plates 26 and 27, and locking device 28, may also be employed as in the embodiment of FIG. 1.

To transfer a patient from a bed to a wheelchair, one end of the curved lower support plate 21 is placed under the patient at the edge of bed 29, and the other end is placed at the edge of wheelchair seat 24. The patient preferably sits on seat 22 with the patient's back facing the convex portion of the curved lower support plate, and the patient's legs within the convex portion of the lower support plate. The patient is carried from the bed to the wheelchair seat as upper seat 22 slides along the curved path formed by recessed track 23. As seat 22 traverses curved track 23, the patient's back is turned toward wheelchair seat 24. Thus, in this embodiment, the patient also requires much less assistance in turning into the sitting position in the wheelchair.

Figure 7:
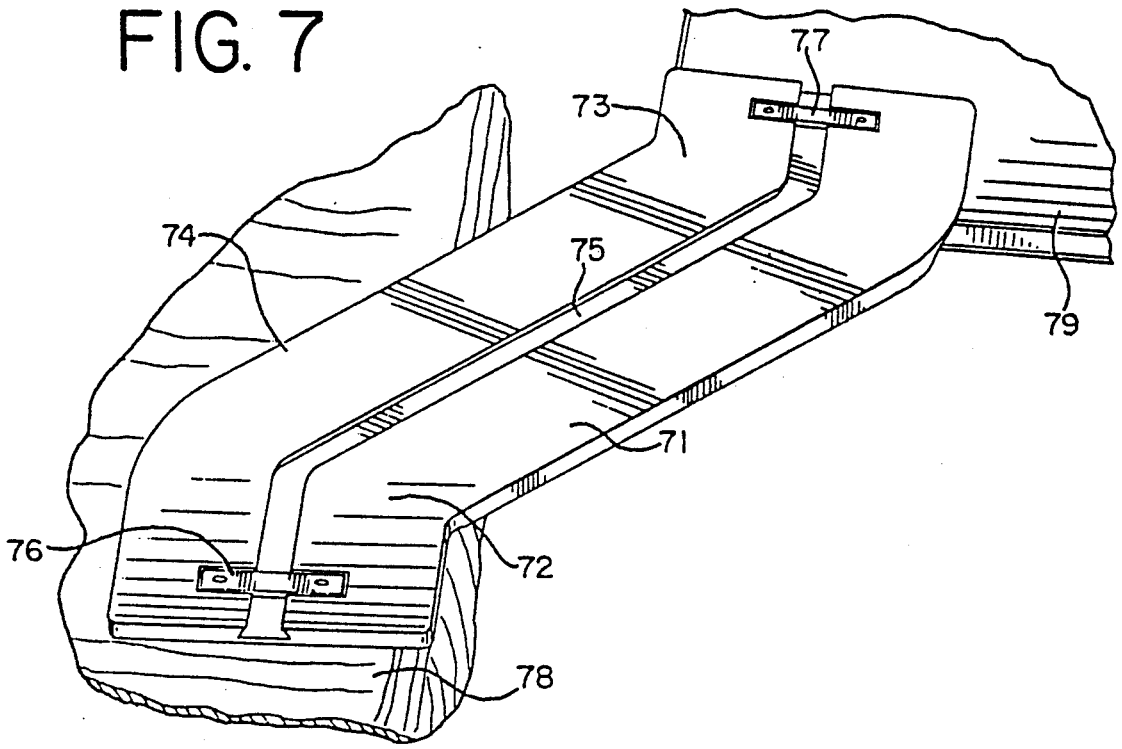
FIG. 7 illustrates a sliding transfer device of the present invention comprising a lower support plate having curves at both ends to form a partial S-shape.
Figure 8:
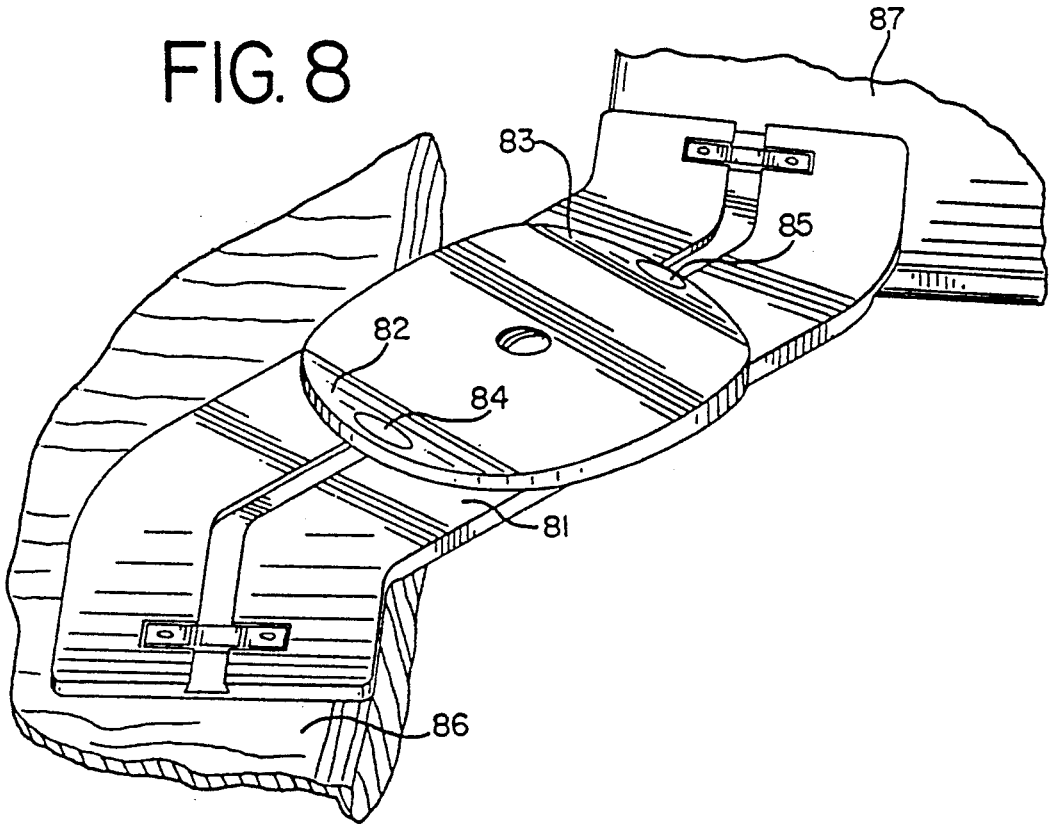
FIG. 8 illustrates a sliding transfer device of the present invention comprising a lower support plate having curves at both ends and a slidable seat having flexible handle flaps.

Preferably the lower support plate comprises a long radius arc. However, any arc, or combination of arcs, which would assist in turning the patient into a sitting position may be employed. Furthermore, the curvature on the top surface may be different at different points in the lower support plate. Thus, the curved lower support plate may contain a long radius arc at one end and a short radius arc at the other end. In this manner, the patient would be assisted even further by a sharper turn by the seat plate at the wheelchair seat end. Alternatively, the curved lower support can contain two equal arcs at opposite ends as shown in FIGS. 7 or 8.

Figure 3:
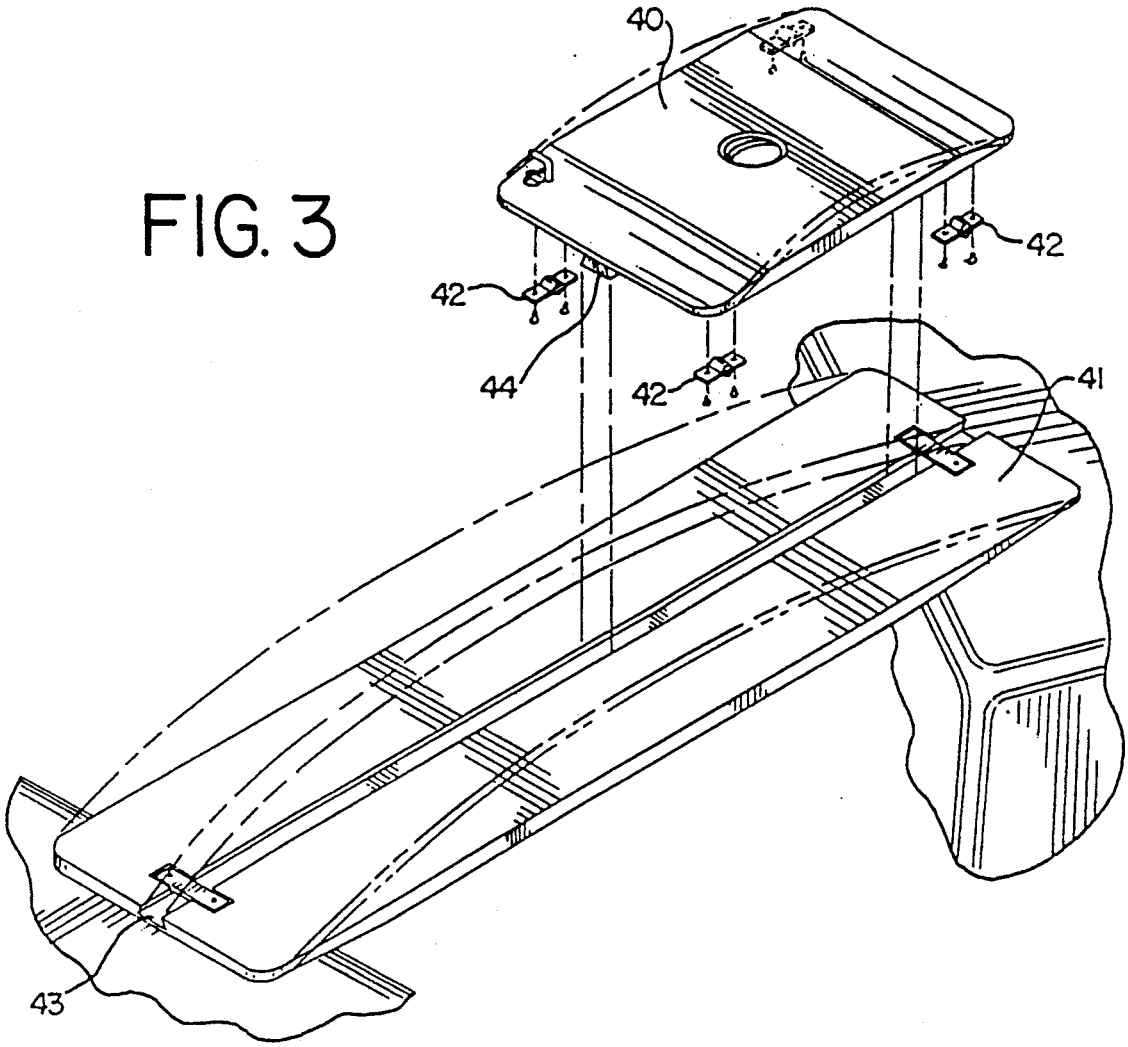
FIG. 3 illustrates an exploded view of a sliding transfer device of the present invention comprising either a substantially rectangular or curved lower support plate.

FIG. 3 is an exploded view of a sliding transfer device of the present invention. In this embodiment, upper seat 40 slidably fits into lower support plate 41 by guide 44 and track 43. Roller wheels 42 may be attached to the bottom of seat 40 to reduce the friction between the seat and the lower support plate. Other means for reducing friction between the upper seat and the lower support plate are contemplated. For example, the recessed guide track may be fitted with inside bearings, or the guide attached to the lower portion of the upper seat may be fitted with outside bearings. Also, a single ball bearing of suitable size may be placed at the bottom of the guide to further reduce friction.

In addition, the bottom surface of upper seat 40 and the top surface of lower support plate 41 may contain a low friction plastic that will permit the upper seat to move across the lower support more easily. The plastic will reduce or eliminate the need for rollers and other friction reducing means. The plastic may be applied to one or both surfaces, and may cover each of the surfaces completely or partially. For example, the plastic may be applied as sheets, as strips or as a combination of sheets and strips. The types of plastic contemplated include those which impart a low friction when contacted with other surfaces and include, but are not limited to, high density polyethylene and polypropylene, and Delrin and Nylon (available from The DuPont Company) and like materials or combinations thereof. In addition, the plastic may be impregnated with Teflon (available from The DuPont Company), glass, talc, and like materials or combinations thereof.

The lower support plate and the upper seat may be constructed of any suitable material, including woods, metals such as stainless steel and aluminum, plastics such as nylon or fiberglass, or combinations of these materials. Also, handles may be provided to assist handling of the lower support plate and sliding transfer device.

In one embodiment, the lower support plate may comprise a top section and a bottom section that are fitted together. In addition, each section of the support plate may be essentially hollow, except for ribs or cross-members to provide strength and support. Such a design will be lightweight and increase the efficiency of storage and use. Preferably, the hollow sections are molded from plastic. Preferably, the top and bottom sections of the lower support plate and the upper seat are made of high density polyethylene and the bottom section of the lower support plate is impregnated with glass to increase strength. A section of Delrin impregnated with Teflon is provide for the bottom of the upper seat to reduce friction when it the upper seat is slid across the lower support plate.

The seat may be any appropriate shape or size, including rectangular, elliptical or circular with shaped edges. Thus, the seat may be cupped in the middle, but flared downwardly at the edges. This configuration will assist the patient to slide onto the device, and prevent clothing or parts of the body from becoming entangled as the seat slides across the lower support plate. The seat may also contain flaps, on one or more ends, that may be flexible, or raised, to further protect the patient's clothing or body parts. Handles may be incorporated into the flexible flaps as shown in FIG. 8.

The seat may be attached to the lower support plate by any suitable means. Preferably, the seat is attached by a guide and track arrangement whereby the seat slides across the length of the top surface of the lower support plate. Other sliding mechanisms known to those skilled in the art, however, are also contemplated. Such mechanisms would include, for example, rails, shoulders, rollers, and combinations thereof. Thus, the track may be set into the lower support plate, as presently preferred, or extend above the lower support plate.

Figure 5:
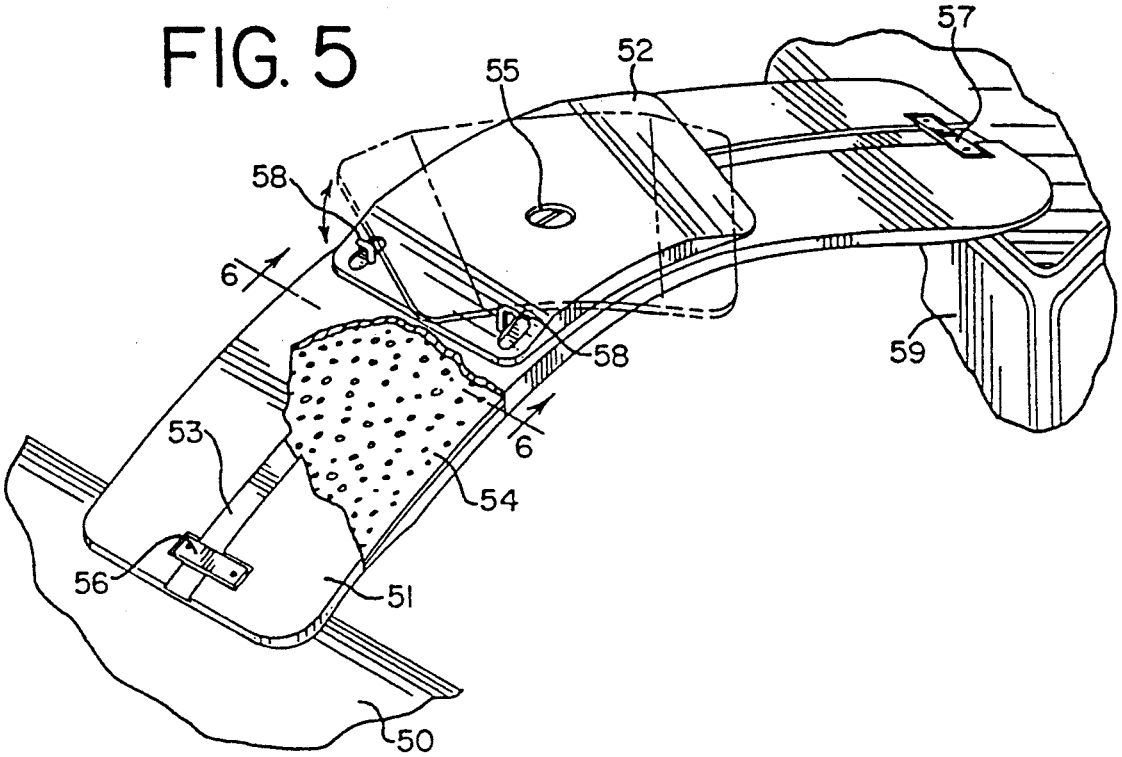
FIG. 5 illustrates a sliding transfer device of the present invention comprising a swivel upper seat.

FIG. 5 illustrates the swivel seat embodiment of the present invention, which comprises an upper seat 52 pivotally attached to a lower support plate 51 by swivel joint 55. The swivel enhances transfer of the patient because it allows either the upper seat or the lower support plate to pivot freely as the patient is moved on and off of the upper seat. Thus, the seat can be moved more easily under the patient because both the seat and the support plate can be maneuvered. After the patient is transferred, the swivel allows the upper seat to turn the patient. For example, if the patient is to be transferred from bed 59 to wheelchair seat 60, the swivel joint 55 allows the upper seat 52 to turn and orient the patient's back toward the wheelchair seat back (not shown), and allows the patient to be easily moved off the upper seat. Means for controlling the range and rotation speed of the seat about the support plate 51, as well as the movement of the seat across the lower support plate 51 may also be employed.

The lower support plate 51 in this embodiment may be any of the shapes contemplated here, including rectangular, curved, or any such combination, and the upper seat is shaped accordingly. Moreover, track 53 is shown as a female recess to accept swivel joint 55, but any track arrangement which will accept a swivel joint may be used.

Figure 6:
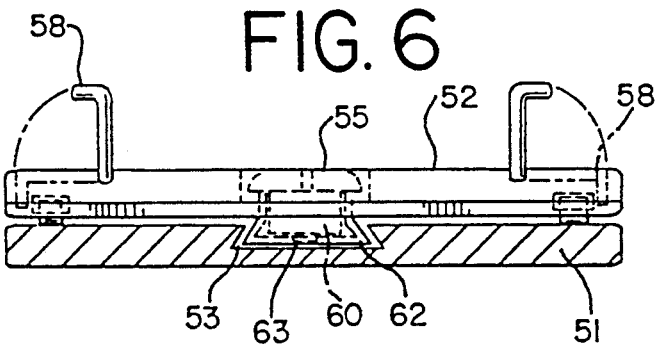
FIG. 6 illustrates a section view of FIG. 5.

Any swivel mechanism known in the art may be used. FIG. 6 illustrates one such mechanism where swivel joint 55 comprises a pin 60 and wedge-shaped housing 62. The pin 60 sets into and is pivotally attached to the housing 62 by rivet 63. Locking devices 58, and lock plates 56 and 57, may also be used to enhance patient safety and control of the upper swivel seat 52. Thus, the swivel mechanism may be adaptable for a track set into or extending beyond the lower support plate.

FIG. 7 illustrates an additional embodiment of the sliding transfer device in which the lower support plate 71 has curved portions 72, 73 at either end to form a partial S-shape. The S-shape can be forward or backward, and is intended to encompass any shape in which the terminal ends of the support plate are curved in arcs of opposite direction to one another. The center portion 74 of the support plate 71 may be substantially rectangular, or may also be curved in any direction. A track 75 is fixed within, and in accordance with the shape of the lower support plate 71. The features already described, such as lock plates 76, 77, are also contemplated. The support plate may be laid across the two transfer locations, such as the edge of a bed 78 and a wheelchair 79, and is operated in the manner already described.

FIG. 8 illustrates an additional seat embodiment of the present invention mounted upon the sliding lower support plate shown in FIG. 7. The upper seat 80 contains flaps 82, 83 located at opposite ends of the seat 80. The flaps may be flexible or jointed so that they may be raised and lowered as needed. The flaps may also contain handle holes 84, 85. The flexible flaps assist in placing the seat under the patient, and protect the patient against entangling clothing or body parts between the upper seat and the lower support plate as the patient is transferred from a bed 86 to a wheelchair 87. The upper seat of FIG. 8 may be employed with any of the lower support plate embodiments, and may be mounted in any of the ways already discussed. One preferable embodiment is to mount the upper seat 80 onto the lower support plate 81 with a swivel joint mechanism of the type described in FIG. 6.

Figure 9:
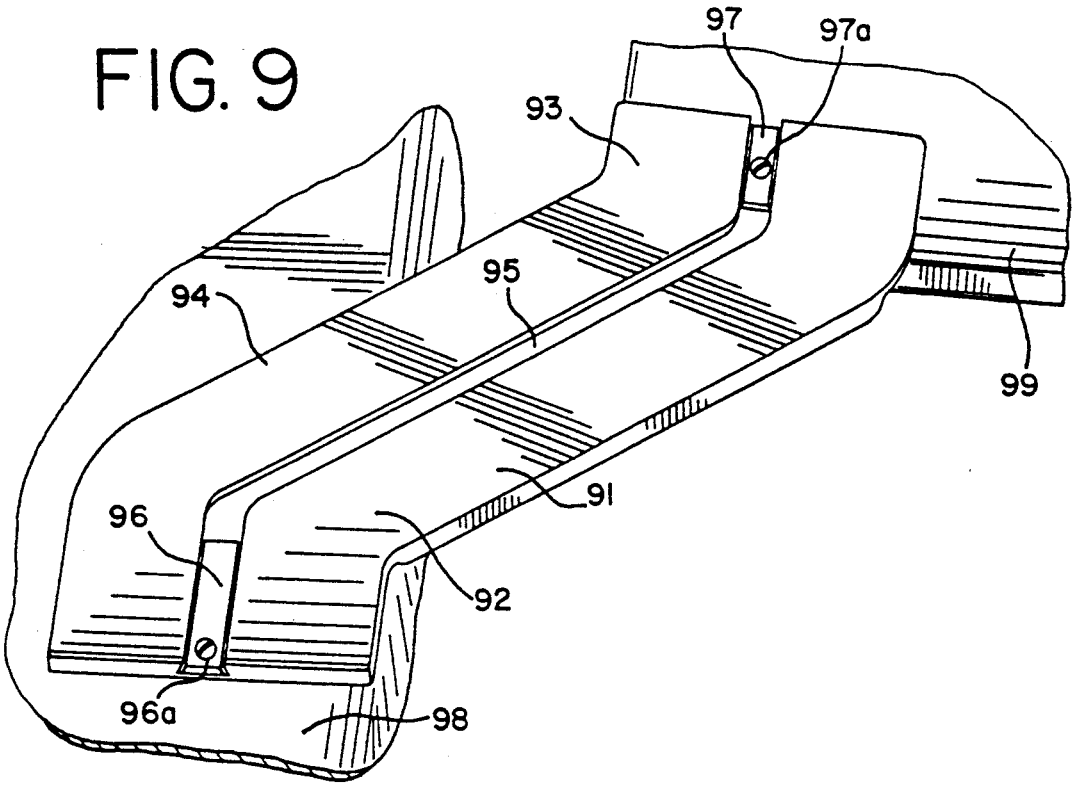
FIG. 9 illustrates a sliding transfer device of the present invention containing removable insert sections.

FIG. 9 illustrates another embodiment where the lower support plate contains removable inserts at the ends instead of lock plates. Lower support plate 91 is shown having curved portions 92 and 93 and center portion 94 to form an S-shape, but it may be any curved shape or straight as already disclosed. The lower support plate 91 comprises a track 95 and ends that are adapted to rest on surfaces 98 and 99. The ends contain removable inserts 96 and 97 that are secured to the lower support plate 91 by thumb screws **96*a* and 97*a*, respectively. The inserts are preferably plastic, but may be constructed of any material compatible with the track 95 and the lower support plate 91**.

The removable inserts 96, 97 allow the upper seat (not shown) to be removed at either end. Thus, the patient that is supported on the upper seat may be transferred to other surfaces, such as that of a wheelchair, without having to be lifted out of the seat. The upper seat can be adapted to fit into the top of a wheelchair seat, or may be slid out from under the patient after the patient has been securely placed on the wheelchair seat. Thus, in moving a patient from a bed to a wheelchair, one end of the sliding transfer device is placed on the bed and the other end is placed on the seat of the wheelchair. The upper seat is brought to the end resting on the bed and the insert section at the end resting on the seat of the wheelchair is removed. The patient is then moved onto the upper seat of the sliding transfer device and transferred to the wheelchair. At the wheelchair end, the upper seat is slid out of the end of the lower support plate and the upper seat and patient are placed on the seat of the wheelchair. The upper seat can then be slid out from under the patient, or fitted into the seat of the wheelchair.

Figure 10A:
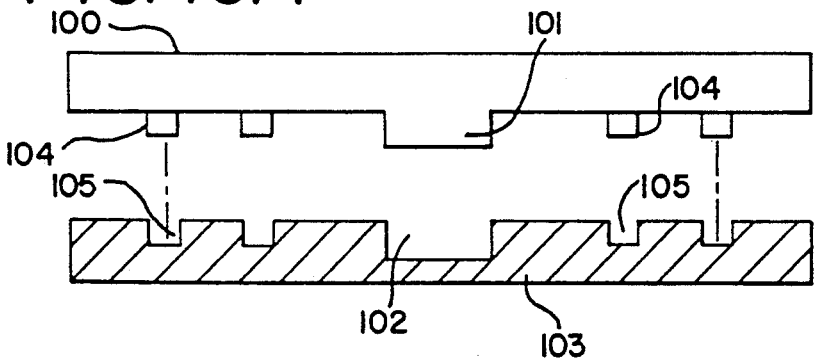
Figure 10B:
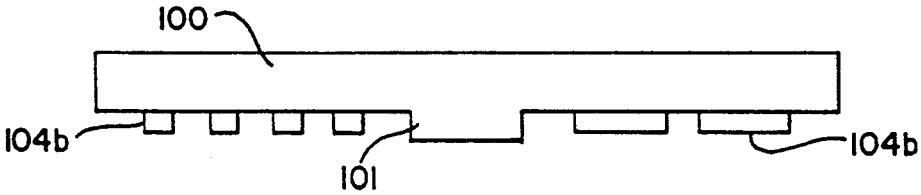
Figure 10C:
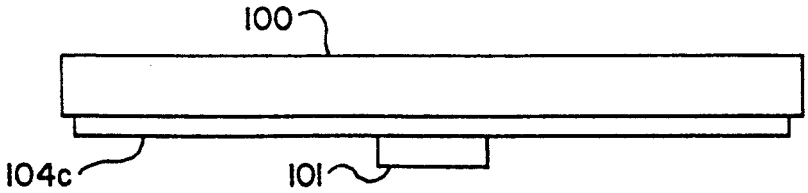

FIG. 10 illustrates an upper seat that may be fitted into a wheelchair seat. It is to understood that a patient is transferred to many types of seats and surfaces, including a wheelchair seat, a commode seat, a car seat, and similar surfaces. The upper seat can be adapted to fit into or on top of any of these surfaces.

Upper seat 100 contains a guide piece 101 that fits into track 102 of a lower support plate 103. The upper seat contains pegs 104 which fit into exterior tracks 105 of the lower support plate 103. The pegs may be constructed of any suitable material, and are preferably molded from plastic that is low friction, or are coated with a low friction material. The pegs or ribs may be constructed of a material that is flexible, or may contain bearings or rollers, so that they may slide through the curved portions of the tracks in a curved lower support plate. The inner portions of the exterior tracks 105 may similarly be coated with a low friction material, such as a low friction plastic, or contain bearings or rollers. The pegs 104 may be spaced apart along the axis of the exterior tracks 105, shown as 104*b* in FIG. 10*b*, or may comprise a rib or raised portion depicted as 104*c* in FIG. 10*c*. The seat of a wheelchair is adapted with slots or tracks to receive the pegs or ribs of the upper seat and secure the upper seat into the wheelchair. Other chairs, seats and similar surfaces may be adapted in a similar fashion. The pegs or ribs also help to support the upper seat and the patient while the seat is resting upon the lower support or is being moved across the lower support.

FIG. 11 illustrates an assembled S-shaped lower support plate of the present invention. The lower support plate comprises a top section 110 and a bottom section 111, and a track 115. In FIG. 11*a*, one-half of the top section 110 is shown from an outside view and the other half is broken away to show the inside of the bottom section 111. The top section 110 has a top surface 112 and exterior tracks or channels 105. The inside portion of the bottom section 111 has ribs 113 and supports or bosses 114. As shown in FIG. 12*a*, bosses 114*a* that are near the end of the bottom section are tapered to accommodate the taper in the outside surface of the bottom section. The cross-members are comolded with the bottom section and serve to support the structure and minimize weight.

FIG. 11*b* illustrates one-half of the bottom section 111 from an outside view with the other half broken away to show the inside of the top section 110. The bottom section 111 contains a hole 116 to allow connection of the upper seat. The pivot joint may be a cap screw as illustrated in FIG. 12*a*. The outside surface of the bottom section 111 is generally smooth and free of encumbrances. However, the surface may be roughened or locking or stabilizing means may be employed to ensure that the transfer device is secure when rested against or on top of the body support. The inside portion of the top section 110 contains comolded cross-members 117 and supports or bosses 118 which cooperate with the ribs 113 and bosses 114 on the inside of the bottom section 111. Bosses 118 are of a male configuration and each have a shoulder that bears against a top surface of a cooperating female boss 114. Cross-members 117 are channelled and are adapted to receive the ribs 113 in the bottom section 111.

FIG. 12*a* is an exploded side view of an end portion of a sliding transfer device of the present invention. The top section 110 and bosses 118 cooperate with the bottom section 111 and bosses 114 to form the lower support plate. The top and bottom sections are fastened with screws 120, such as oval head screws, which bear against the outside of the bottom section 111, pass through the interior of bosses 114 and secure to the threaded interior of bosses 118.

FIG. 12*a* also illustrates an upper seat 121, a pad 122 having a bottom surface 124 and a screw cap upper portion 125. The pad 122 is fastened to the bottom of the upper seat 121 with fasteners or glue, and is constructed of a plastic material that will reduce the friction between the upper seat and the lower support plate when the seat is moved, preferably Delrin impregnated with Teflon, both of which are available from The DuPont Company.

The pad 122 contains a cylindrical screw cap upper portion 125 which bears threads 126 on the outside. The screw cap bottom portion 123 contains a shoulder support section 128 that bears threads 127 on the inside of an extended cylindrical portion 129. The threads 127 cooperate with threads 126 to secure the upper seat 121 which may be tightened or loosened with the aid of finger grips 130. The shoulder support section 128 fits into the track 115 to hold the upper seat 121 in place. The bottom portion of the screw cap 123 may be tightened or loosened as needed to adjust movement of the upper seat 121. Hole 116 provides sufficient room to fit and tighten the bottom portion of the screw cap to the top portion.

FIG. 12*b* illustrates a bottom surface 124 of pad 122 containing flat portions 125 and raised portions 126. The raised portions 126 aid in supporting the upper seat on the lower support plate and also may be designed to adapt the upper seat to fit into other body supports, such as a wheelchair.

The invention comprises additional embodiments such as a belt of approximately 20 to 30 inches which may be provided to hold the patient on the seat. Furthermore, handles may be provided at appropriate locations on the seat and the lower support plate to provide balance and safety for the patient. Finally, the lower support plate may be formed around a support frame such as a perforated metal frame 54 shown in FIG. 5. In this embodiment, plastic or a similar material encases the frame which adds strength to the device without adding significant weight.

Also any means for aiding in sliding the upper seat across the lower support plate is contemplated. While the bearing arrangements under the seat and in the track already contemplated will reduce friction and assist movement of the seat, additional assistance may be required. Furthermore, the patient may have to transfer alone, and a power aid would reduce the effort required.

One such power aid comprises a small electrical motor, which may be battery operated and rechargeable. The motor is inserted in the support guide to provide or assist in the power needed to slide the upper seat from end to end of the lower support plate. Thus, a small gear near the bottom of the plate can be provided to mesh with a strip containing teeth and placed along the inside of the track. The seat moves across the support plate as the motor turns the gear. Additional known power aids, such as those employing various spring arrangements, are also contemplated.

I claim:

1. A portable sliding transfer device comprising a seat that is adapted to support a human user for movement between one body support, such as a bed, to another body support, such as a wheelchair, said device comprising:

a) a lower support plate having a substantially flat top surface and ends adapted to be removably positioned proximate and in contact with said body supports, b) an open-ended track attached to the top surface, said track including removable inserts at the ends, and c) a removable upper seat which is attached to the lower support plate such that the upper seat is slidable over the top surface of the lower support plate.

2. The sliding transfer device of claim 1 wherein the upper seat comprises a guide affixed to the bottom portion of the seat, said guide slidably fitting into the track.

3. The sliding transfer device of claim 1 wherein the upper seat, the lower support plate or a combination thereof, comprise means for reducing the friction between the upper seat and the lower support plate.

4. The sliding transfer device of claim 3 wherein a bottom portion of the upper seat, the top portion of the upper support plate or a combination thereof comprise a low friction plastic.

5. The sliding transfer device of claim 1 wherein the top surface of the lower support plate is substantially rectangular, and the upper seat is slidable over the length of the top surface.

6. The sliding transfer device of claim 1 wherein the top surface of the lower support plate is curve-shaped, and the upper seat is slidable over the path of the curve.

7. The sliding transfer device of claim 1 wherein the top surface of the lower support plate is S-shaped.

8. The sliding transfer device of claim 1 wherein the upper seat is pivotable with respect to the top surface of the lower support plate.

9. The sliding transfer device of claim 1 wherein the lower support plate comprises a supported top section and a bottom section which are joined together.

10. The sliding transfer device of claim 1 wherein the upper seat is adapted to fit a body support.

11. A portable sliding transfer device comprising a seat that is adapted to support a human user for movement between one body support, such as a bed, to another body support, such as a wheelchair, said device comprising:

a) a curved lower support plate having a substantially flat top surface and ends adapted to be removably positioned proximate and in contact with said body supports, b) an open-ended track attached to the top surface, said track including removable inserts at the ends, and c) a removable upper seat which is attached to the lower support plate such that the upper seat is slidable over the top surface of the lower support plate.

12. The sliding transfer device of claim 11 wherein the top surface of the lower plate comprises more than one curvature.

13. The sliding transfer device of claim 11 wherein the top surface of the lower support plate is S-shaped.

14. The sliding transfer device of claim 11 wherein the upper seat is pivotable with respect to the top surface of the lower support plate.

15. The sliding transfer device of claim 11 wherein the lower support plate comprises a supported top section and a bottom section which are joined together.

16. The sliding transfer device of claim 11 wherein the upper seat is adapted to fit a body support.

17. A portable sliding transfer device comprising a seat that is adapted to support a human user for movement between one body support, such as a bed, to another body support, such as a wheelchair, said device comprising:

a) an S-shaped lower support plate having a substantially flat top surface and ends adapted to be removably positioned proximate and in contact with said body supports, b) an open-ended track attached to the top surface, said track including removable inserts at the ends, and c) a removable upper seat attached to the lower support plate such that the upper seat is slidable over the top surface of the lower support plate.

18. The sliding transfer device of claim 17 wherein the lower support plate comprises a supported top section and a bottom section which are joined together.

19. The sliding transfer device of claim 17 wherein the upper seat is adapted to fit a body support.

20. A portable sliding transfer device comprising a seat that is adapted to support a human user for movement between one body support, such as a bed, to another body support, such as a wheelchair, said device comprising:

a) a lower support plate having a substantially flat top surface and ends adapted to be removably positioned proximate and in contact with said body supports, b) a track attached to the top surface, c) an upper seat, and d) a guide affixed to the bottom portion of the upper seat, said guide slidably attached to the track thereby attaching the upper seat to the lower support plate so that the upper seat is slidable over the top surface of the lower support plate.

21. A portable sliding transfer device comprising a seat that is adapted to support a human user for movement between one body support, such as a bed, to another body support, such as a wheelchair, said device comprising:

a) a lower support plate having a substantially flat top surface and ends adapted to be removably positioned proximate and in contact with said body supports, and b) an upper set which is attached to the lower support plate such that the upper seat is slidable over the top surface of the lower support plate.

22. A method for transferring a user between a first body support, such as a bed, and a second body support, such as a wheelchair, the method comprising:

a) providing a portable transfer device having a lower support plate with two ends and an upper seat, the upper seat being slidable over the lower support plate between the two ends;

b) positioning the lower support plate between the first and second body supports so that the ends are in contact with the body supports;

c) positioning the upper seat to face upward near the end proximate the first body support;

d) setting the user upon the upper seat;

e) moving the upper seat toward the end proximate the second body support; f) setting the user onto the second body support.

* * * * *

UNITED STATES PATENT AND TRADEMARK OFFICE

CERTIFICATE OF CORRECTION

PATENT NO. : 5,282,284
DATED : February 1, 1994
INVENTOR(S) : Robert F. Brantman It is certified that error appears in the above-indentified patent and that said Letters Patent is hereby corrected as shown below:

In column 2, line 10, delete "illustrates" and substitute --illustrate--.

In column 2, line 12, delete "illustrates" and substitute --illustrate--.

In column 2, line 14, delete "illustrates" and substitute --illustrate--.

In column 4, line 47, delete "nylon" and substitute --Nylon--.

In column 4, line 63, delete "provide" and substitute --provided--.

In column 4, line 64, delete "it"

In column 6, line 53, after "to" insert --be--.

UNITED STATES PATENT AND TRADEMARK OFFICE

CERTIFICATE OF CORRECTION

PATENT NO. : 5,282,284
DATED : February 1, 1994
INVENTOR(S) : Robert F. Brantman It is certified that error appears in the above-indentified patent and that said Letters Patent is hereby corrected as shown below:

Column 10

In claim 21, line 10, delete "set" and substitute --seat--.

Signed and Sealed this

Third Day of September, 1996

*Attest:*

*Attesting Officer*

BRUCE LEHMAN

*Commissioner of Patents and Trademarks*